United States Patent [19]

Jerney et al.

[11] 3,963,161

[45] June 15, 1976

[54] SHEET FEEDER FOR CUPPING PRESS

[75] Inventors: Thomas D. Jerney; Paul S. Petersen, both of Minnetonka, Minn.

[73] Assignee: MTS Systems Corporation, Minneapolis, Minn.

[22] Filed: Feb. 10, 1975

[21] Appl. No.: 548,612

[52] U.S. Cl. ..... 226/150; 226/159; 226/162

[51] Int. Cl.[2] ..... B65H 17/36

[58] Field of Search ..... 226/142, 146, 150, 158, 226/160, 162, 159

[56] References Cited

UNITED STATES PATENTS

| | | | |
|---|---|---|---|
| 2,720,261 | 10/1955 | Koch | 226/158 |
| 3,726,458 | 4/1973 | Rabl | 226/146 |
| 3,741,458 | 6/1973 | Aylesworth | 226/162 |

*Primary Examiner*—Evon C. Blunk
*Assistant Examiner*—Robert Saifer
*Attorney, Agent, or Firm*—Dugger, Johnson & Westman

[57] ABSTRACT

A reciprocating sheet feeder for feeding sheet material into a press, such as a deep draw cupping press. The sheet feeder comprises a rocking or pivoting framework that has gripper means thereon for gripping the edges of the sheet to be fed and when the frame is rocked about its pivot axis, moving a length of the sheet into the press and then releasing the sheet prior to a return stroke for the rocking feeder.

The grips of the rocking feeder thus reciprocate during use. The feeder is used in combination with edge guides that are positioned ahead of the grips with respect to the direction of movement of the sheet so that the sheet is primarily guided while under tension. The pivoting frame is made so that it does not have substantial strength in torsion or in lateral directions of the sheet, so that the sheet essentially guides the frame during the feeding stroke to avoid buckling or misguiding the sheet. The framework does have rigidity needed for moving the sheet in its longitudinal direction.

12 Claims, 6 Drawing Figures

SHEET FEEDER FOR CUPPING PRESS

BACKGROUND OF THE INVENTION

1. FIELD OF THE INVENTION

The present invention relates to feeder devices for feeding increments of a sheet stock material at preselected intervals.

2. PRIOR ART

The feeding of sheet material with reciprocating feeders has long been a problem, due in large part to the need for promptly feeding a precise increment of material into a punch press between strokes. At the present time, the most common feeders comprise intermittently operated feed rolls that drive the stock into the press. In addition, some types of direct gripping, linear, reciprocating feeders are utilized, but these generally have to be operated at relatively slow speeds, or the gripper that is used for gripping this sheet material will tend to tear out because of the inertia of the sheet. Further, the guiding of the sheets has been a problem because the sheet is usually pushed through guides. The sheet then tends to buckle or crease, or the conventional feeder will skew the sheet slightly during the feeding operation causing a jam in the press.

SUMMARY OF THE INVENTION

The present invention relates to a feeding device for feeding light sheet stock material in preselected increments. The feeder is used with devices that require intermittent feeding of incremental lengths of sheet stock or strip material, for example, in a punch press operation. As shown the unit is designed for feeding thin sheets of material into a deep draw press used for drawing seamless cups that are eventually formed into cans.

The feeder is a pivoting or rocking frame having a pair of grippers which engage opposite sides of the sheet, and that will grip or release the sheet in response to external commands. The rocking frame is positioned immediately adjacent the entry opening to the tooling for the punch press. The sheet is primarily guided along its edges by guides that are positoned ahead of the rocking feeder with respect to the direction of travel of the sheet. In other words, the rocking feeder will push only a short portion of the sheet into the tooling area, but will pull the sheet through its primary edge guides.

The rocking feeder is a pivoting frame that is made to be very weak in torsion, and in side to side directions, but is driven through a hydraulic servo ram in the longitudinal direction of the sheet, or in other words in the direction of feed of the sheet and has rigidity in this direction to pull the sheet through the edge guides and push portions of the sheet into the tooling area. The feeder grips are actuated to clamp the sheet adjacent its edges when the rocking guide is retracted, and then hold the sheet as the grips and frame are pushed toward the tooling area, thereby delivering a new portion of the sheet to the tooling area. Then the edge grips release the sheet during the work stroke of the press and the frame is retracted to its starting position with the grips released.

The feeder is quite simple to manufacture because there is no need for intermittent rotary drives, and it uses a servo controlled hydraulic cylinder for the reciprocating action necessary to obtain the incremental feed for feeding the press in the form shown, although other mechanical drives may also be used.

The frame for the rocking feeder is made with lost motion connections to permit it to move from side to side and in torsion, but it is positively stopped in its retracted position prior to gripping the edges of the sheet so that the grippers are aligned properly with the sheet. The frame also is positively stopped mechanically in its forward feed direction to insure that a proper length of material is being fed into the die or tooling area. The stops used in the retracted position are spaced apart in direction transverse to the direction of the sheet, so that when the frame is stopped, it is properly aligned by engaging two known, mechanical stops.

BRIEF DESCRIPTION OF THE DRAWINGS

FIG. 1 is a top plan view of a rocking feeder made according to the present invention with parts in section and parts broken away;

DESCRIPTION OF THE PREFERRED EMBODIMENTS

Figures 2, 4:
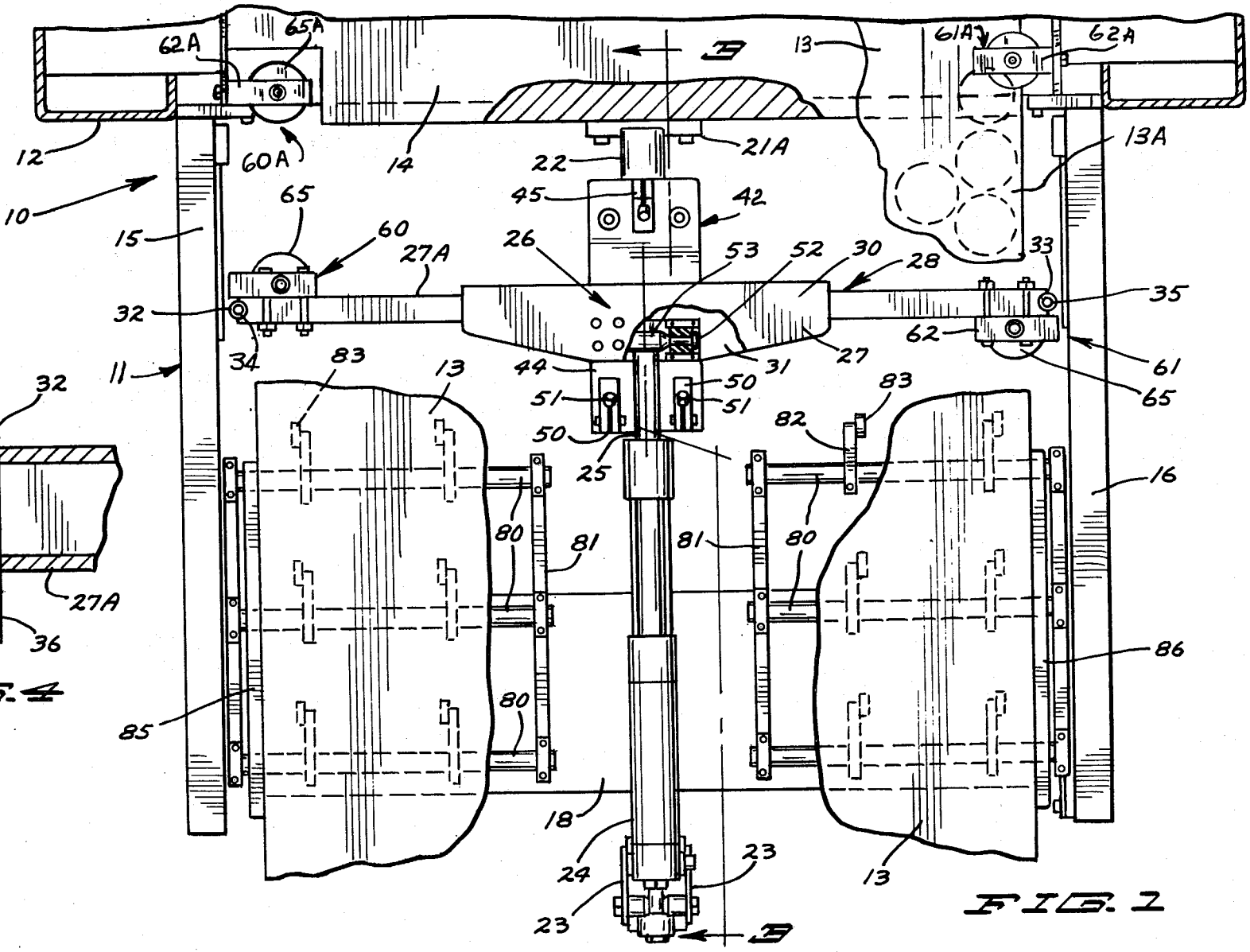
FIG. 2 is a sectional view taken generally on the line 2—2 in FIG. 3, with also parts in section and parts broken away.
FIG. 4 is an enlarged sectional view of the junction between a rocking frame upright member and frame cross member.
Figure 2:
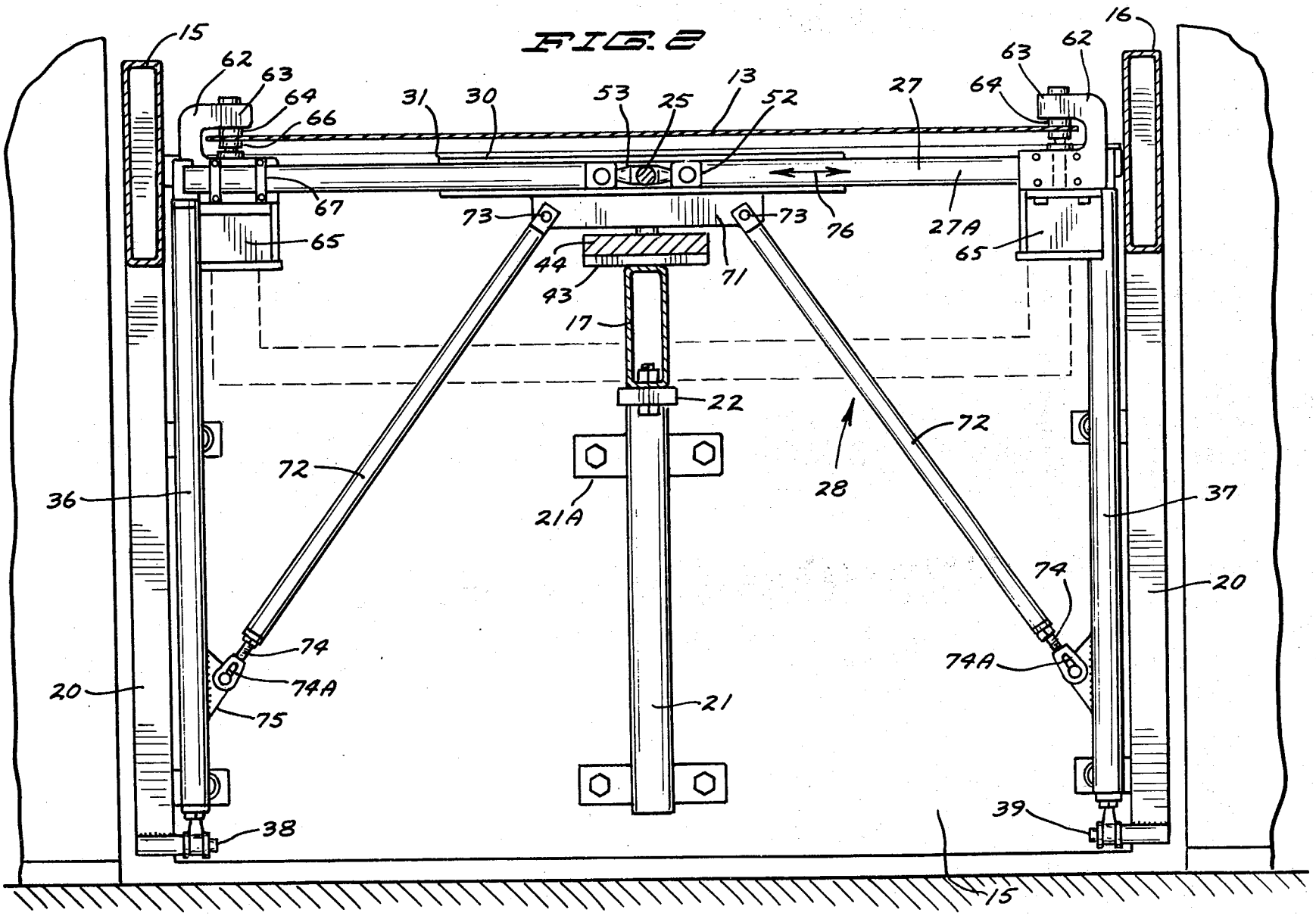

A sheet feeder illustrated generally at 10 comprises a frame assembly 11 that is positioned on the input or infeed side of a work press 12. The press 12 is used for forming members out of a sheet of material indicated at 13 that is fed from a coil in the usual manner. The work press 12 has a die set bed 14, and a vertical frame section on which the frame 11 is fixedly mounted. The die set bed 14 has an infeed edge which is shown in FIG. 1. The sheet 13 may be fed through a suitable sheet lubricator, and formed into an overhead supply loop as shown in the copending application of Paul S. Petersen, Ser. No. 544,691, filed Jan. 28, 1975, entitled Sheet Prefeeder Forming An Overhead Stock Loop To The Input Of An Incremental Feeder For A Cupping Press. The feeder of the present invention is used to precisely, and quickly feed material through the use of a reciprocating or rocking mechanism actuated through a servo controlled hydraulic ram.

Figures 3, 5, 6:
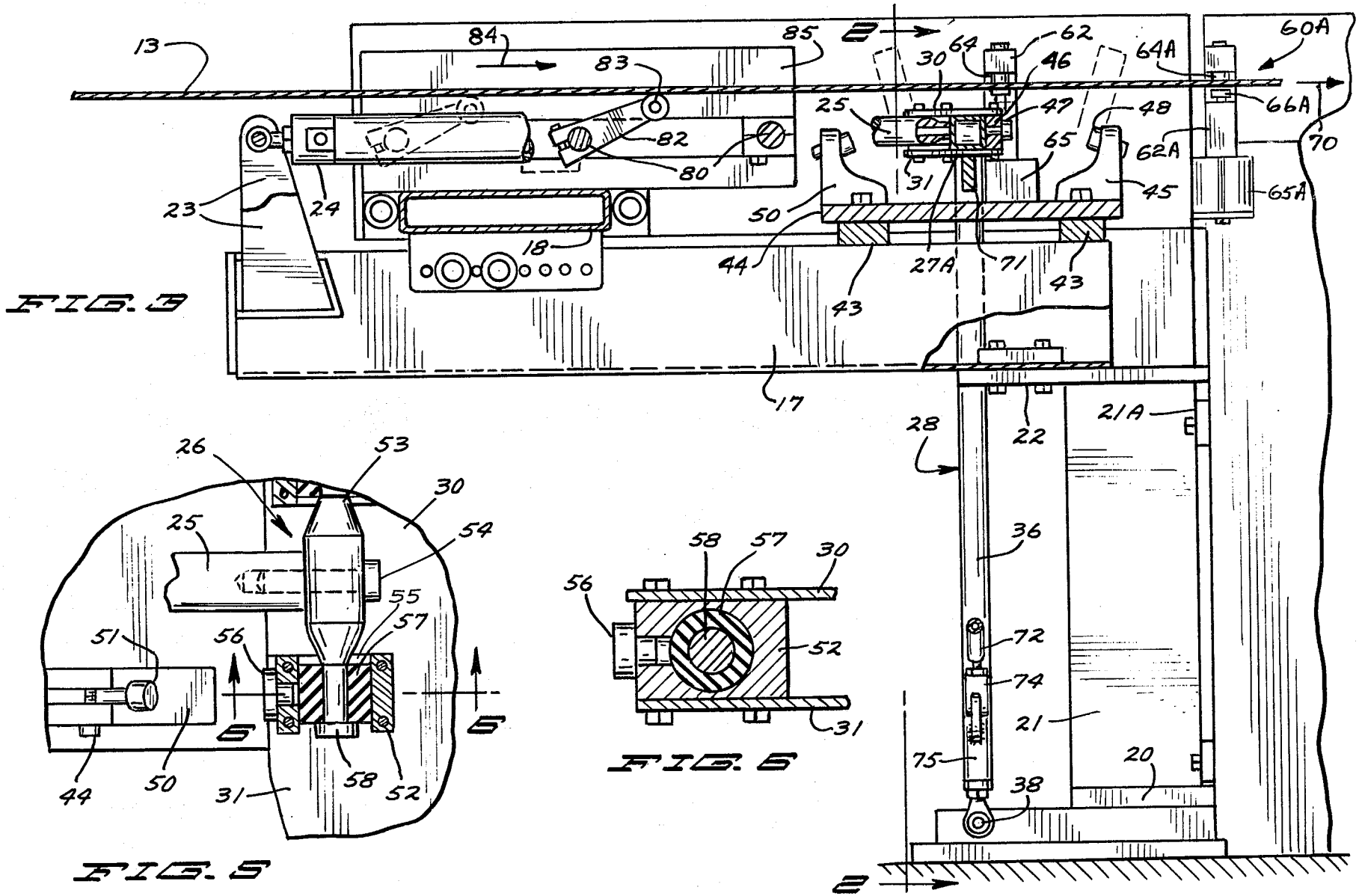
FIG. 3 is an elevational view taken as generally along 3—3 in FIG. 1.
FIG. 5 is an enlarged fragmentary view showing the connections between a hydraulic ram and frame cross member, with parts in section and parts broken away.
FIG. 6 is a sectional view taken on line 6—6 on FIG. 5.

The frame assembly for the sheet feeder includes a first side rail 15, a second side rail 16, and a center longitudinal rail 17 (see FIG. 2). In addition, a cross support 18 is fixed to the center and side rails with suitable cap screws, as shown in FIG. 3.

The inner ends of the side rails 15 and 16 are mounted on vertical supports 20 which in turn are bolted with suitable brackets directly to the upright frame of the press 12. The center member 17 also is supported on an upright member 21, and this upright member 21 is bolted with suitable brackets 21A to the press frame, as shown. The center support upright 21 has a plate 22 at the top thereof on which the box section center member 17 is bolted with a suitable clamp.

The outer end of the center member has a pair of upright brackets 23 fixed on opposite sides thereof, which in turn support the base end of a hydraulic actuator 24 that extends forwardly toward the press and has an actuable rod 25 that can be extended and retracted in a reciprocating path. The rod 25 is connected through a suitable attachment assembly 26 to a cross member assembly 27 of a rocking or pivoting feeder frame indicated generally at 28. The ram 24 is a servo controlled ram having servo controls that are programmed in a desired manner, and the ram can be extended or retracted at a substantial rate of speed. The cross member 27 as shown comprises a square tube 27A that has a pair of plates 30 and 31 on the top and bottom thereof in the center portions for attachment of the rod 25. The tube 27A in turn has a pair of sleeves 32 and 33 at the opposite ends thereof, as shown in more detail in FIG. 4, and these sleeves as shown are welded directly to the tube 27A. Each of the sleeves 32 and 33, is fixed to a shaft 34 and 35, respectively, that in turn are fixed to pivoting upright members 36 and 37, respectively. The upright members 36 and 37 are pivotally mounted through suitable rod end bearings to shafts 38 and 39 at the lower end of the upright frames 20, as shown and thus the two pivoting upright members 36 and 37 pivot about horizontal axes in an arc as the ram 24 moves the center cross member assembly 27.

It can be seen that the cross member 27 is above the center support beam 17, and also above a stop assembly indicated generally at 42. The stop assembly is mounted onto suitable cross supports 43,43 and is fixed to the center member 17 on the top side thereof. A plate 44 of the stop assembly is fixed to these cross supports 43,43. The plate 44 is also below the cross member 27 of the pivoting frame 28. As shown, an indeed or forward stop 45 is fixed to the plate 44 adjacent to the bed of the die or press assembly. The plates 30 and 31 have a block 46 fixed therebetween which carries a stop button 47 that aligns with the stop 45 to provide a direct mechanical stop in the forward of infeed direction of the frame 28. When the ram 24 extends rod 25, it pushes the frame assembly toward the press or die bed, to feed material, the positive stop between members 47 and 48 will provide a precise location of the frame in its forward or infeed position.

The plate 44 also supports a pair of laterally spaced return stroke stops 50, which can perhaps be best seen in FIG. 1. These return stroke stops are positioned on opposite lateral sides of the center line of the ram 24, and include adjustable stop members 51 that face toward the cross frame or member 27, and align with support blocks 52,52 fixed to the cross member 27 on opposite sides of the center line of the actuator. On the return stroke, these two stops 52,52 and 50,50 will position the cross member 27 at two laterally spaced locations to square up the cross member, as will be more fully explained.

The attachment assembly 26 between the rod 25 and the cross member 27 includes means to permit flexing movement between the cross member 27 and the rod 25. As shown, in FIGS. 5 and 6, the attachment assembly 26 includes a rigid cross member 53 that is fixed to the end of the rod 25 with a cap screw 54. The cross member 53 has tapered end portions that are of size to partially fit within openings 55 of the support blocks 52. The support blocks 52 as shown have stop buttons 56 fixed thereto and aligned with the stop members 51.

The openings 55 are each of size to receive and hold an elastomeric tubular bushing 57, and suitable fastening screws 58 can be threaded into the opposite ends of the cross member 53 and supported on sleeves of metal that are surrounding these cap screws 58 to prevent the bushings from being compressed in axial direction when the screws 58 are tightened. The elastomeric bushings 57 thus provide a flexible joint between the cross member 53, and the cross frame assembly 27. The elastomeric bushings will permit torsional movement of the member 53 as the rod 25 extends and retracts. The pivoting frame assembly 28 pivots about the axes of the shafts 38 and 39, and also the bushings 57 will permit some racking of the pivoting frame or in other words some twisting about a central vertical axis of the cross member.

The cross tube 27A has a pair of clamp assemblies 60 and 61, respectively at the opposite ends thereof. As shown, these clamp assemblies each include a frame member 62 formed into an open jaw shape, and the upper jaw member 63 has a clamp button 64 adjustably mounted thereon for adjustment in vertical direction. The lower portion of the clamp assemblies 60 and 61 each have a pneumatic cylinder 65 mounted thereon, and the cylinders 65 have internal pistons and actuable rods. The rods have clamp buttons 66 on the ends thereof, which are vertically aligned with the jaw buttons 64. The rods pass through provided openings in the lower portion of the frame members 62.

These clamp assemblies 60 and 61 are mounted onto the cross tube 27A with straps as shown at 67 on the opposite side of the tube 27A from the respective clamp assembly, and suitable bolts are passed between the frame portion of the clamp and the straps 67 to clamp the units in place with the pneumatic cylinders extending downwardly below the cross members 27A. The upper jaw buttons 64 lie along a plane which would be very close to the top plane of the sheet of material 13 when the sheet of material is lying in the horizontal plane lying on the feed line or feed axis indicated generally at 70 in FIG. 3. This feed line is in the feed plane of the die set 14 of the work press being used. By actuating the pneumatic cylinders 65, to push the buttons 66 on the ends of the respective rods toward the jaw button 64, the sheet 13 can be clamped between these two buttons under the pressure exerted by the respective cylinders. The attachment of the cylinders 65 to the frame members 62 generally is with cap screws that are used on suitable brackets for the short stroke pneumatic cylinders 65. The cylinders themselves extend below the tube 27A, so that they are out of the way of the tube.

Stationary clamps 60A and 61A are mounted on the bed 14 in position to hold the sheet 13 on the retraction stroke of the frame. The clamps 60A and 61A are made to operate in the same way as clamps 60 and 61, the stationary clamps carry the suffix A after the numeral.

The clamps are positioned to grip the sheet 13 in waste areas of the sheet as indicated at 13A. That is, where circles are punched from the sheet an area of waste between rows of circular punch outs is inevitable. This area is shown at 13A in FIG. 1 where punch outs are represented by dotted circles. The edge area between punch outs is used for clamping and high clamping forces may be exerted in these edge waste areas. If the sheet is slightly deformed when clamped the deformity will not jam the machine because it occurs in a waste area. Thus the gripping force of the feed clamps can be much greater than the force which could be safely applied to the sheet in the areas used for punch outs. If a roller type feeder is used, the pressure of the roller is exerted on the sheet in all areas, even punch outs, so the force from the rollers must be properly controlled.

The pivoting frame assembly comprising the uprights 36,37, and the cross member 27 has a pair of diagonal braces that permit limited racking movement of the uprights relative to the cross tube 27A. As shown, a bracket 71 is fixed to the lower side of the plate 31 in the center portions of the frame, and a pair of diagonal braces 72 are pivotally mounted as at 73 to opposite ends of the member 71. Each brace has an adjustable end member 74 that is pivotally mounted to a bracket 75 on the respective upright members 36 or 37. The members 74 are bifurcated and each has an elongated hole 74A so that the end member 74 can slide for a limited distance in a axial direction relative to the bracket 75. The length of holes 74A is exaggerated in the drawings for clarity and in practice will be only about ¼ inch.

Thus, the braces 72,72 will permit easy flexing of the cross member 27 in side to side directions as indicated by the double arrow 76. The lower ends of the upright members 36 and 37 that mount on the shafts 38 and 39 are mounted through suitable rod ends which have the normal part spherical seat bearings, and the upright members are therefore quite easily flexed in side to side direction. The uprights are rigid and flex easily, and the length of the cross member 27A permits some bending of this tube as the pivoting frame moves laterally from side to side. However, the side to side movement is limited by the length of the slots 74A in the diagonal braces to control this movement within desired limits.

The sheet 13 is supported and guided in a suitable manner at the input or upstream end of the frame, and as shown in FIGS. 1 and 2, a plurality of transversely extending shafts 80 are mounted on suitable brackets to the respective frame members 15 and 16, and the inner ends of the shafts also are supported on separate frame members 81. The shafts 80 do not go all away across the frame but are spaced to provide room for the ram 24. The frame members 81 are fixed to the cross member 18, and extend in fore and aft direction. Suitable shaft clamps are used in the opposite ends of the shafts 80 for supporting them in proper position.

In addition, a number of adjustable support roller assemblies 82 are clamped onto the shafts 80 (there are generally two on each shaft), and these roller assemblies 82 include rotatable rollers 83 that engage and support the sheet 13 for its movement in its infeed direction that is indicated by the arrow 84 in FIG. 3. The rollers support the sheet 13 with a minimum amount of drag on the sheet to make feeding easier. The rolling contact and low number of rollers makes much less frictional drag than conventional supports.

The edges of the sheet 13 are guided by fore and aft, or longitudinally extending edge guide plates 85 and 86, respectively, which guide plates also are mounted on the shafts 80 adjacent the respective frame members 15 and 16. These edge guide plates, as shown are upstream of the feed clamp members 60 and 61, and thus the sheet is guided by guide members that are positioned so that the feed clamps for the sheet place the sheet in tension as the sheet goes through the main guide members. Downstream guides in the die set of the press are provided, but these are of short length. The guides in the die set position the sheet properly for the punching operation.

An overhead feed loop of material at the infeed end lowers inertia of the sheet as shown in the aforementioned pending application of Paul S. Petersen, and this lowering of inertia, plus the ability to grip the sheet extremely tightly in waste areas permits the reciprocating feeder to operate quite fast. Use of servo controls for the ram 24 permits controlling acceleration and deceleration of the sheet as desired to minimize the possibility of tearing out the edges of the sheet where the clamps are fastened. Other reciprocating drives also may be used.

The ability to move the sheet quickly with edge clamps, even though the sheet 13 is relatively thin material, for example in the order of 0.010 to 0.020 inches in thickness is enhanced by not attempting to push the sheet through the main edge guides. If the sheet is in compression it tends to buckle and fold from any drag caused by the edge guides. The pivoting frame assembly 28 is made so that it is very weak in torsion, and in side to side movement, so that the sheet itself guides the frame as the frame is pivoted or rocked rather than the frame attempting to guide the sheet.

In operation, the ram 24 is retracted, so that the rod 25 pulls the pivoting frame 28 back so that the stop buttons 56 contact the respective stop members 51,51. Because the stop members 51,51 are laterally spaced and are properly and precisely positioned, the cross member 27 can be positively, mechanically, positioned in its retracted position at right angles to the feed direction. When the cross member or cross assembly 27 is properly positioned, the pneumatic cylinders 65 of the clamps on the movable frame are actuated to push the buttons 66 against the underside of the sheet 13, and clamp the sheet between the buttons 64 and 66. The sheet is then held along its edges (in waste areas) and the pivoting frame has been very precisely positioned so that it is perpendicular to the longitudinal direction of the sheet. The stationary clamp assemblies 60A and 61A will of course be released (cylinders 65A are retracted) to permit sheet 13 to move.

The rod 25 of ram 24 then can be accelerated at a desired rate under servo control to push the sheet stock into the die assembly along the feed line 70 and pull the sheet through edge guides 85 and 86. The guides 85 and 86 guide the sheet when it is under tension so that there is no tendency to buckle the sheet as the pivoting frame is moved by the ram. It can be seen that the upright members 36 and 37 pivot about the axes of the respective shafts 38 and 39 so that there is an arcuate motion of the clamp assembly 60 and 61 as they move to the infeed position but the members 36 and 37 are of sufficient length so this arcuate motion does not adversely affect feeding the sheet. The mechanical stop buttons 46 and 47 positively limit the amount of feed, and because the button 48 can be adjusted, the amount of feed can also be adjusted very precisely.

When the ram has been extended so that the stop members 47 and 48 contact each other, the ram may be driven to compress the elastomeric bushings 57 forming the connection to cross member 27 before it is stopped. The statonary clamp assemblies 60A and 61A are then clamped by operating the pneumatic cylinders 65A to move clamp buttons 66A against the sheet and grip the sheet against buttons 64A. The cylinders 65,65 are then retracted so that the clamp buttons 64 and 66 of the movable feed clamps release the sheet. Then the die in the press can be operated on its stroke on the new material that has been fed into the die while the stationary clamps 60A and 61A hold the sheet and rod 25 is retracted to return the cross frame assembly to its initial starting position positively stopped back on the stop buttons 51,51. The frame is again precisely returned to position wherein the cross member 27A is perpendicular to the infeed direction. If the sheet 13 tends to move or shift, the frame assembly 28 will also move or shift because frame assembly 28 is not rigid. The respective clamps 60 and 61 can rack or twist about an upright axis and move laterally relatively freely, and the elastomeric bushings 57 also permit this racking without substantial resistance to movement. The frame member can move from side to side because of the provided slots on the diagonal braces 72. The flexibility of the cross member 27 and upright members 36 and 37 is provided so that the sheet 13 constrains movement of the frame 28 in side to side direction. The stationary clamps are again released by actuating the cylinder 65A through suitable valves before the next feed stroke.

The elastomeric bushings 57 which are used in the connection between rod 27 and cross member assembly 27 permit the ram 25 to actually overdrive the cross member against the stops provided in both directions to insure that the exact feed distance is obtained.

Therefore the rocking or pivoting frame is guided by the sheet except in its infeed direction wherein the rocking frame has substantial strength to push the sheet into the press. Because the edge guides are upstream of the clamps for holding the sheet, however, there is very little friction on the sheet along its edges, and the sheet is guided substantially only where it is under tension to prevent buckling.

What is claimed is:

1. A feeder device for feeding a sheet of material in predetermined incremental lengths in a first direction along a feed line, said sheet of material having a predetermined width, said feeder comprising a frame member including a cross member and elongated support members attached to said cross member pivotally mounted to the feeder about an axis substantially perpendicular to the direction of travel of a sheet of material being fed, gripping means mounted on said cross member and positioned adjacent the edges of a sheet of material being fed, said gripping means being controllable to grip or release edge portions of a sheet being fed, means for reciprocating said frame member and gripping means in said first direction and in an opposite direction along said feed line as the frame member pivots about said axis, and edge guide means for a sheet being fed positioned on a side of said gripping means so as to guide a sheet as it is under tension prior to entry of portions of a sheet into said gripping means as the sheet is moved in the first direction, said elongated members being mounted to permit limited movement of said cross member transverse to the feed line under transverse forces transmitted by a sheet being fed.

2. A feeder device for feeding a sheet of material in predetermined incremental lengths in a first direction along a feed line, said sheet of material having a predetermined width, said feeder comprising a frame member pivotally mounted to said feeder about an axis substantially perpendicular to the direction of travel of a sheet of material being fed, gripping means positioned adjacent the edges of a sheet of material being fed and mounted on said frame member, said gripping means being controllable to grip or release edge portions of a sheet being fed, means for reciprocating said gripping means in said first direction and in an opposite direction along said feed line as the frame member pivots about said axis, edge guide means for a sheet being fed positioned on a side of said gripping means so as to guide a sheet as it is under tension prior to entry of portions of a sheet into said gripping means with respect to the first direction, first mechanical stop means to stop movement of said gripping means in the first direction, and second mechanical stop means to stop movement of said gripping means in opposite direction from the first direction, said second mechanical stop means including two spaced stop members engaging portions of said means to reciprocate at locations spaced laterally with respect to the feed line, said second stop means thereby positioning at least portions of said means to reciprocate and said gripping means in a predetermined orientation relative to the feed line.

3. Sheet feeder means for feeding sheets of material intermittently in preselected feed lengths, said feeder means comprising a support member, a pivoting frame including elongated support arms pivotally mounted to said support member about a frame pivot axis, a cross member connected between said support arms, said support arms being flexible to permit limited twisting movement of the frame about a central frame axis perpendicular to said pivot axis, separate clamp means at the opposite ends of said cross member and positioned to have portions thereof spaced from the edges of a sheet being fed and having clamp members actuable to clamp a sheet being fed adjacent its edges, said support arms being of sufficient length so that during the arc of movement of said pivoting frame the deviation of said clamp members from a preselected feed plane is not of substantial effect in feeding a sheet held by the clamp means, power means to move portions of said pivoting frame in a reciprocating direction about the pivotal axis thereof, and stop means to positively stop said pivoting frame in each direction of pivotal movement including individual stops on opposite sides of a plane defined by the central frame axis and perpendicular to the frame pivot axis, said stops being positioned to engage said frame at two spaced locations to orient said clamp means in a known relationship to the frame pivot axis as the frame pivots in at least one direction.

4. The combination as specified in claim 3 and guide means mounted on said support member to guide edges of a sheet of material to be fed by said sheet feeder means, said guide means being mounted in a location so that the sheet of material being fed is pulled through said guide means when said frame is reciprocated.

5. The combination of claim 3 wherein said flexible supports are mounted to guide said second reciprocating frame relative to said first frame to permit lateral and twisting movement of said clamp means as guided by a sheet being fed, and stop means acting between said first frame and said reciprocating frame when the reciprocating frame reaches its retracted position, said stop means including stop elements spaced laterally on opposite sides of said feed axis in the direction of the width of a sheet being fed to engage said reciprocating frame and orient said clamp means in a known relation to the feed axis when the frame is in a retracted position.

6. The combination of claim 5 and second stop means acting between said first frame and said second reciprocating frame when the second reciprocating frame reaches its infeed position.

7. A sheet feeder device for feeding thin sheet material into a work press or the like, comprising a first frame member, means to mount said first frame member adjacent an infeed side of a work press, means on said first frame member to support a sheet of material to be fed at a position spaced from the said work press, a second reciprocating frame mounted on said first frame member and positioned between said means to support a sheet of material and the work press, said reciprocating frame including clamp means to engage and hold edge portions of a sheet to be fed, means to reciprocate said reciprocating frame along a feed axis for a sheet of material so that said clamp means are moved back and forth in direction parallel to the feed axis, means to actuate said clamp means to grip a sheet of material when the reciprocating frame is in a retracted position and to hold a sheet as the reciprocating frame is moved toward the work press to an infeed position, and said clamp means being actuated to release said sheet when the reciprocating frame reaches the infeed position and as the reciprocating frame is reciprocated back to its retracted position, and edge guide means for a sheet to be fed positioned adjacent said means to support on a side of said reciprocating frame opposite from the work press so that a sheet being fed is pulled by said clamp means through said edge guide means, said second reciprocating frame including flexible supports attached to the first frame which permit said clamp means to move laterally of the feed axis under lateral forces exerted by a sheet of material being fed.

8. The combination of claim 7 wherein said flexible supports of said second reciprocating frame are elongated and first ends of said flexible supports being pivotally mounted to said first frame.

9. The combination as specified in claim 7 wherein said work press forms circular cut outs in a sheet being fed thereinto, and stop means on said first frame engaging said reciprocating frame when in retracted position to locate said clamp means in relation to the work press to clamp a sheet being fed in an area between portions of the sheet used for the circular cut outs.

10. The combination of claim 7 wherein said means to reciprocate comprises a servo controlled hydraulic ram having a rod that is reciprocated under pressure, and means for connecting said rod to said frame including resilient elements permitting the rod to be driven to compress said resilient elements after the stop elements engage said frame.

11. The combination of claim 7 and second releasable clamp means fixedly mounted on said first frame actuable to hold a sheet being fed while the second frame is reciprocated from the infeed position to the retracted position.

12. The combination of claim 7 and support means for a sheet positioned between said edge guide means comprising a plurality of spaced rollers.

* * * * *